US006389345B2

(12) United States Patent
Phelps

(10) Patent No.: US 6,389,345 B2
(45) Date of Patent: May 14, 2002

(54) METHOD AND APPARATUS FOR DETERMINING A CROSS SLOPE OF A SURFACE

(75) Inventor: Stephen K. Phelps, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/866,933

(22) Filed: May 29, 2001

Related U.S. Application Data

(63) Continuation-in-part of application No. 09/342,997, filed on Jun. 29, 1999, now Pat. No. 6,275,758.

(51) Int. Cl.[7] ..... G05B 19/18

(52) U.S. Cl. ..... 701/50; 701/200; 701/213; 172/4.5; 172/2; 172/789; 477/35

(58) Field of Search ..... 701/50, 200, 207, 701/213; 475/84, 86; 477/35; 180/235, 197, 13 L; 172/4.5, 1, 789, 45, 2, 751

(56) References Cited

U.S. PATENT DOCUMENTS

| | | | | |
|---|---|---|---|---|
| 4,926,948 | A | 5/1990 | Davidson et al. | |
| 5,078,215 | A | 1/1992 | Nau | |
| 5,107,932 | A | 4/1992 | Zachman et al. | |
| 5,356,238 | A | 10/1994 | Musil et al. | |
| 5,375,663 | A | 12/1994 | Teach | |
| 5,401,115 | A | 3/1995 | Musil et al. | |
| 5,612,864 | A | 3/1997 | Henderson | |
| 5,742,915 | A | 4/1998 | Stafford | |
| 5,764,511 | A | 6/1998 | Henderson | |
| 5,815,826 | A | 9/1998 | Henderson et al. | |
| 5,941,658 | A | 8/1999 | Dahlinger et al. | |
| 5,951,613 | A | 9/1999 | Sahm et al. | |
| 6,076,029 | A | 6/2000 | Watanabe et al. | |
| 6,112,145 | A | 8/2000 | Zachman | |
| 6,125,561 | A | 10/2000 | Shull | |
| 6,129,156 | A | 10/2000 | Boast et al. | |
| 6,174,255 | B1 * | 1/2001 | Porter et al. | 475/84 |

FOREIGN PATENT DOCUMENTS

| | | |
|---|---|---|
| EP | 0 501 616 A2 | 9/1992 |
| GB | 2 129 034 A | 5/1984 |
| WO | WO 82/03645 | 10/1982 |
| WO | WO 97/01005 | 1/1997 |

* cited by examiner

*Primary Examiner*—William A. Cuchlinski, Jr.
*Assistant Examiner*—Olga Hernandez

(57) ABSTRACT

The present invention provides a method and apparatus for determining the cross slope created by a work implement on a work machine operating in an articulated or non-articulated manner. The method includes the steps of determining a position of the work implement, determining a direction of travel of the machine, and responsively determining the cross slope.

33 Claims, 11 Drawing Sheets

Fig. 7a.
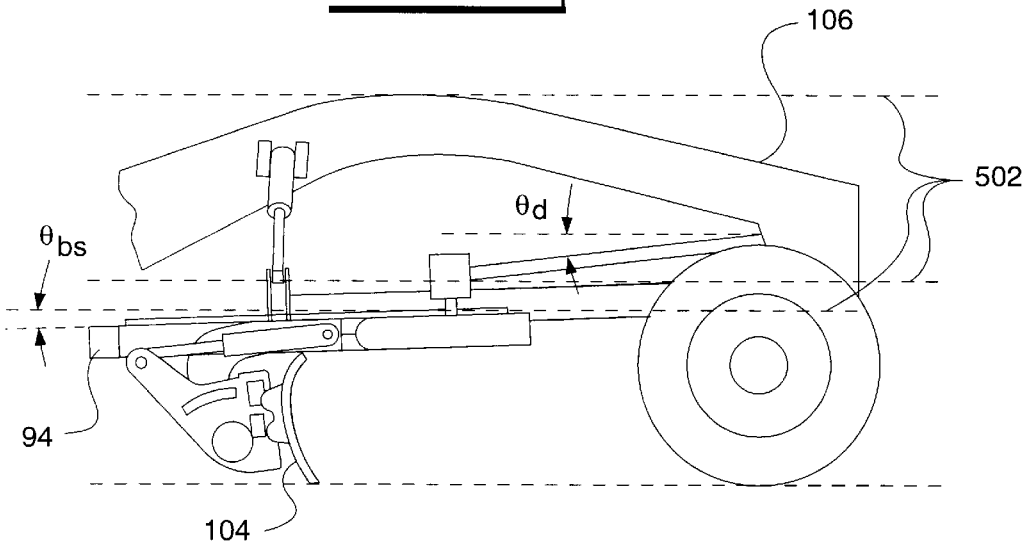
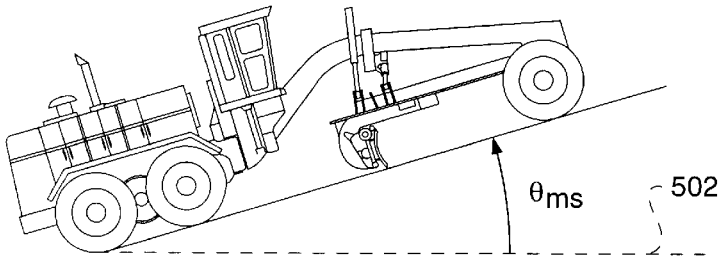
Fig. 7b.
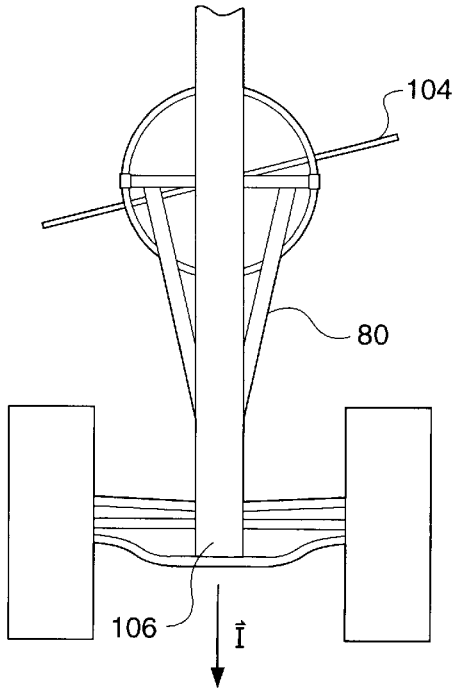
Fig. 8.

METHOD AND APPARATUS FOR DETERMINING A CROSS SLOPE OF A SURFACE

This is a continuation-in-part of U.S. application Ser. No. 09/342,997, U.S. Pat. No. 6,275,758, filed Jun. 29, 1999.

TECHNICAL FIELD

This invention relates generally to an implement control system for a work machine and, more particularly, to a method and apparatus for determining a cross slope created by a work machine.

BACKGROUND ART

In one embodiment, the cross slope created by a work machine, such as a motor grader, may be described as the slope of a line lying on a surface path, such as a road, which is perpendicular to the direction of the path. Cutting an accurate cross slope into a land site is an important function for a work machine such as a motor grader; an accurate cross slope allows for proper run-off of water, and, if the unfinished is properly graded, pavement is more easily and accurately laid. Therefore, it would be advantageous to accurately determine the cross slope. The determined cross slope may be provided to the machine operator or compared to a desired cross slope in order to determine if the machine is creating the appropriate slope and to make adjustments to the blade position if a position error is occurring.

Some previous implementations of systems for determining cross slope utilize GPS and laser technologies to determine the position of the blade and the machine relative to the land site, thereby enabling a cross slope of cut of the blade to be determined. However, the required GPS and laser detection systems are expensive and are not easily implemented in remote sites, such as when cutting a road in a remote location.

In addition, other previous implementations of systems do not utilize GPS and laser technology but do use techniques which provide inaccurate information. For example, the angle of rotation of the blade may be used to ultimately determine the cross slope. Some systems determine an angle of rotation of the blade relative to the direction of travel of the blade using velocity transducers or radar guns for measuring the ground velocity in the direction of travel of the blade. However, these systems are expensive and have associated inaccuracies due, in part, to the fact that the accuracy decreases as the measured velocity approaches zero.

Further, other previous implementations did not account for the appropriate variables. Sensing too few parameters may lead to an inaccurate determination of cross slope.

The present invention is directed to overcoming one or more of the problems as set forth above.

DISCLOSURE OF THE INVENTION

In one aspect of the present invention, a method for determining a cross slope created by a work implement on a work machine is disclosed. The method includes the steps of determining a position of the work implement, determining a direction of travel of the machine, and determining the cross slope created by the machine.

In another aspect of the present invention, a method for determining a cross slope created by a work implement on a work machine is disclosed. The method includes the steps of sensing a plurality of machine parameters, sensing a plurality of work implement parameters, and determining the cross slope created by the machine.

In another aspect of the present invention, an apparatus for determining a cross slope created by a work machine having a work implement is disclosed. The apparatus includes a machine sensor system for sensing a plurality of machine parameters and responsively generate a plurality of machine parameter signals, a work implement sensor system adapted to determine a plurality of work implement parameters and responsively generate a plurality of work implement parameter signals, and a controller adapted to receive the machine parameter signals and the work implement parameter signals, and determine the cross slope created by the machine.

BRIEF DESCRIPTION OF THE DRAWINGS

FIG. 7*a* is an example of blade pitch angle;

FIG. 7*b* is an example of machine pitch angle;

FIG. 8 is an example of the direction of travel of the non-articulated machine;

BEST MODE FOR CARRYING OUT THE INVENTION

The present invention includes a method and apparatus for determining a cross slope created by a work implement on a work machine.

I. Assembly of the Work Machine

Figure 1A:
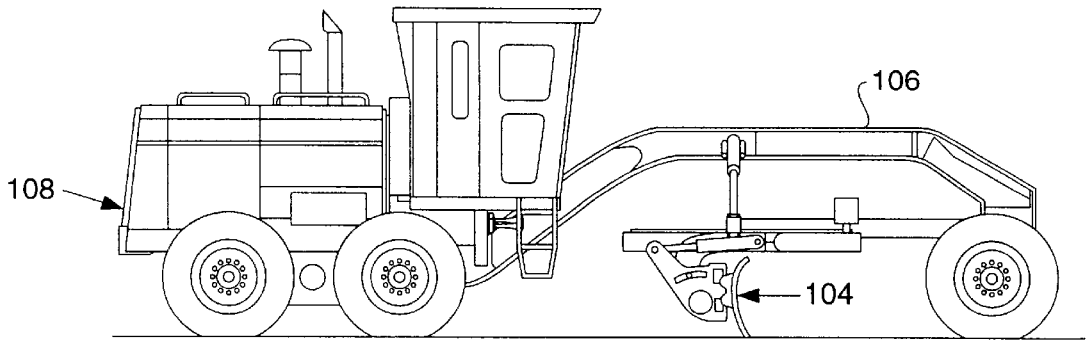
FIG. 1*a* is a high level diagram of a first embodiment of an implement control system on a non-articulated work machine.

A work machine 108 includes a frame 106 upon which a work implement 104 is controllably movably mounted, as illustrated in FIG. 1*a*. In a first embodiment, the work implement is a blade 104, and the work machine 108 is a motor grader operating in a non-articulated manner.

Figure 1B:
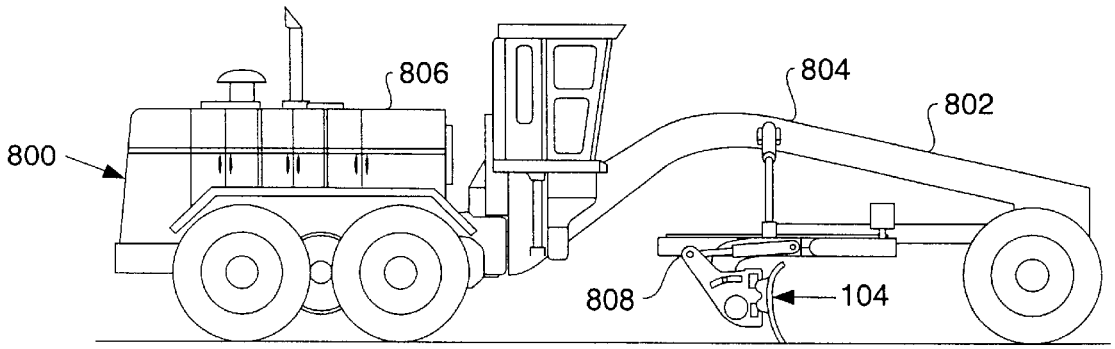
FIG. 1*b* is a high level diagram of a second embodiment of an implement control system on an articulated work machine.

In a second embodiment, as seen in FIG. 1*b*, the work machine 800 may be a motor grader operating in an articulated manner. The machine 800 has a frame 802, including a front frame 804 movably connected to a rear frame 806, the front frame 804 rotatable relative to the rear frame 806. The work implement 808, which is controllably movably mounted on the front frame 804, is identical to that found in the first embodiment, namely blade 104.

It is to be noted that other machines such as dozers, scrapers, compactors, pavers, profilers, and the like, equipped with suitable surface altering equipment, are equivalents and considered within the scope of the invention. In addition, other work implements may be used without departing from the spirit of the invention.

Figure 2:
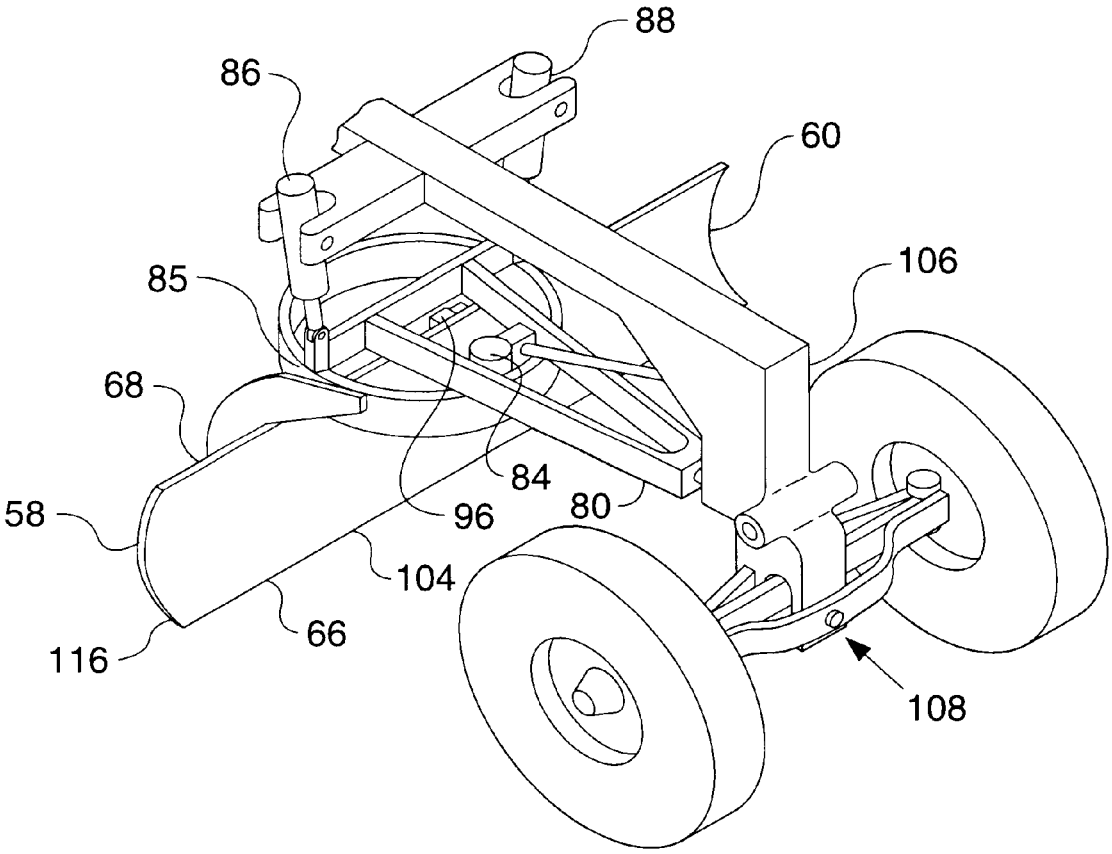
FIG. 2 is a diagrammatic block diagram of a front portion of a motor grader.
Figure 3:
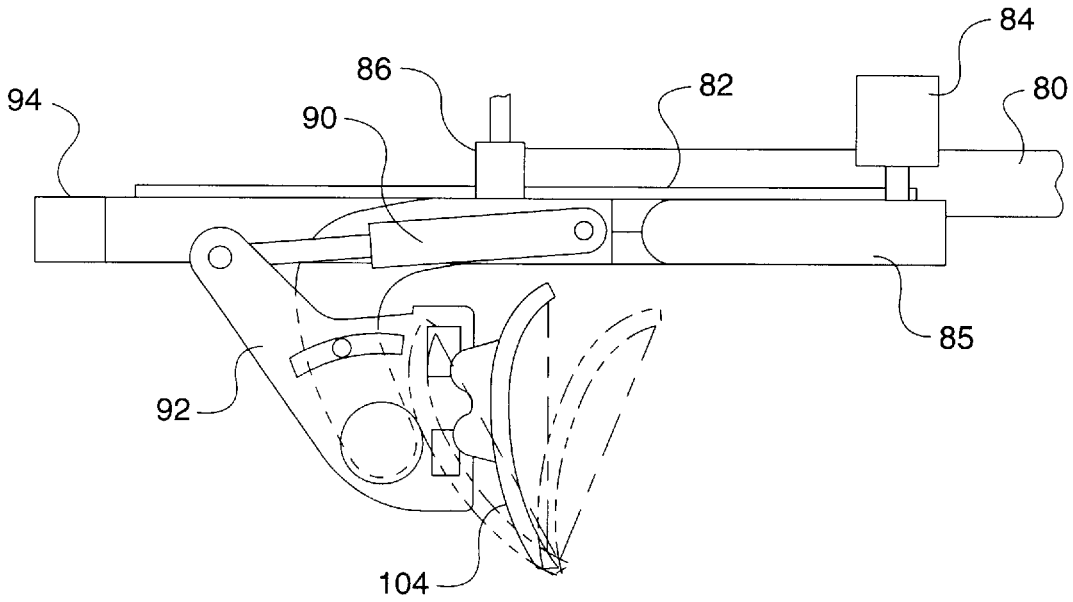
FIG. 3 is a diagrammatic side view of the work implement.

The blade 104, as shown in FIGS. 2 and 3, is movably connected to the frame 106 or 804 by a supporting mechanism 80, or drawbar. The supporting mechanism 80 preferably includes a circle drive mechanism 82 having a selectively actuatable rotary drive motor 84 for rotating a circle 85, and the blade 104 connected thereto about an elevational axis located at the center of the circle 85 in a known manner.

As best seen in FIG. 2, the machine 108 or 800 may include a first and second selectively actuatable fluid operated lift jacks 86 and 88 which are connected to and between the frame 106 or 804 and the drawbar 80. The first and second lift jacks 86 and 88 are extensibly movable between first and second spaced apart positions and elevationally move the blade 104 relative to the frame 106 or 804. Simultaneous extension of the lift jacks 86 and 88 lowers the blade 104 and simultaneous retraction of lift jacks 86 and 88 raises the blade 104. Extension or retraction of either the first and second lift jacks 86 or 88, or extension of one of the first and second lift jacks 86 or 88 and retraction of the other of the lift jacks 88 or 86 results in rolling of the blade 104 relative to the frame 106 or 804.

As shown in FIG. 3, a fluid operated tip jack 90 may be connected to and between the drawbar 80 and a bellcrank 92. The bellcrank 92 pivotally connects the blade 104 to the circle drive mechanism 82. The tip jack 90 is extensibly movable for tipping the bellcrank 92 about the pivotal connection. This results in tipping movement of the blade 104 in forward or rearward directions, as shown in phantom lines in FIG. 3, with the blade 104 oriented transversely of the vehicle frame 106 or 804. It should be noted that the terms blade tip and blade pitch are used interchangeably and have the same meaning.

Figure 4:
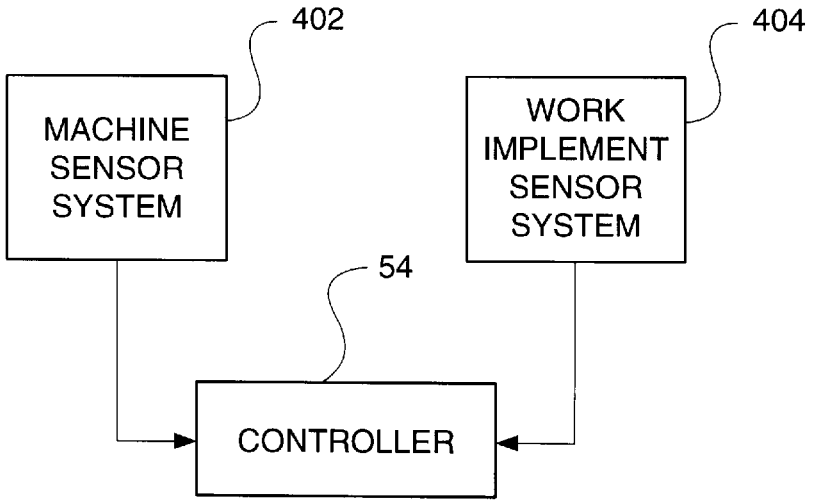
FIG. 4 is a view of the apparatus for determining a cross slope created by the machine.

In one embodiment, the machine 108 or 800 may include a machine sensor system 402 and a work implement sensor system 404 electrically connected to a controller 54, as illustrated in FIG. 4. The machine sensor system 402 is adapted to sense at least one machine parameter and responsively generate at least one machine parameter signal. The work implement sensor system 404 is adapted to sense at least one work implement parameter and responsively generate at least one work implement parameter signal.

As best seen in FIG. 3, the work implement sensor system 404 may include a pitch sensor assembly 94 provided for sensing the pitch angle of the blade 104. The pitch sensor assembly 94 may include any appropriate transducer capable of sensing the pitch of the blade 104. In the preferred embodiment the sensor assembly 94 measures the pitch of the blade with respect to the earth's gravity. The sensor assembly 94 may include a potentiometer, an encoder, a resolver, or the like. In the preferred embodiment, the sensor assembly 94 is connected to the circle 85; alternatively, the sensor assembly 94 may be connected to the bellcrank 92. The pitch sensor assembly 94 generates a pitch angle signal, which may be either analog or digital. Alternatively, the pitch sensor assembly 94 may sense the pitch of the blade 104 relative to the machine 108 or 800.

The work implement assembly 404 may include a roll sensor assembly 110 for sensing a roll angle of the blade 104. The roll sensor assembly 110 may include any appropriate transducer capable of sensing the rolled position of the blade 104. In an alternative embodiment, the roll sensor assembly 110 and the pitch sensor assembly 94 may be located on the machine frame 106 or 804 and the appropriate translations performed to determine the pitch and roll of the blade 104. Alternatively, the roll sensor assembly 110 may determine a roll angle of the blade relative to the machine.

The angle of rotation of the blade 104 relative to the drawbar 80 may be determined by monitoring the position of the circle drive mechanism 82. Alternatively, the work implement sensor system 404 may include a blade rotation sensor 96 for determining the rotation of the blade 104 relative to the drawbar 80.

The machine sensor system 402 may include a pitch sensor assembly 112, a roll sensor assembly 114, and an articulation angle sensor assembly 115. The pitch sensor assembly 112 and the roll sensor assembly 114 may be analogous to the pitch and roll sensor assemblies 94 and 110 respectively and may be located on the machine frame 106 or 802 to sense the pitch and roll angles of the machine 108 or 800. In an alternative embodiment, the machine pitch and roll angles may be derived from the sensed pitch and roll angles of the blade 104. The articulation angle sensor assembly may be located on the machine frame 802 to sense the rotation angle of the front frame 804 relative to the rear frame 806.

Figure 5:
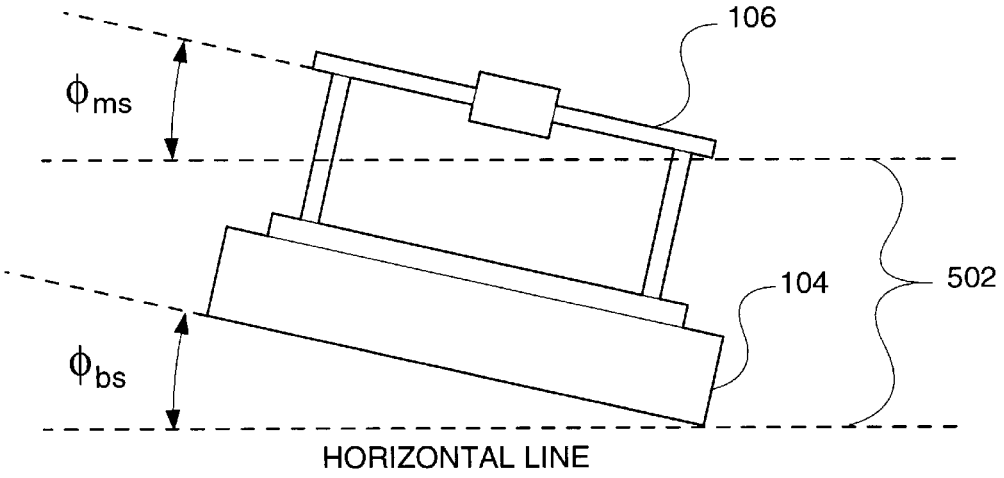
FIG. 5 is an example of blade roll angle and machine roll angle.
Figure 6:
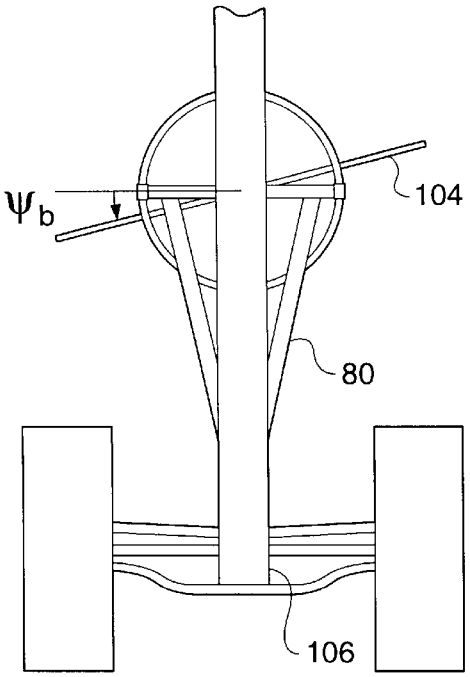
FIG. 6 is an example of angle of rotation of the blade.
Figure 9:
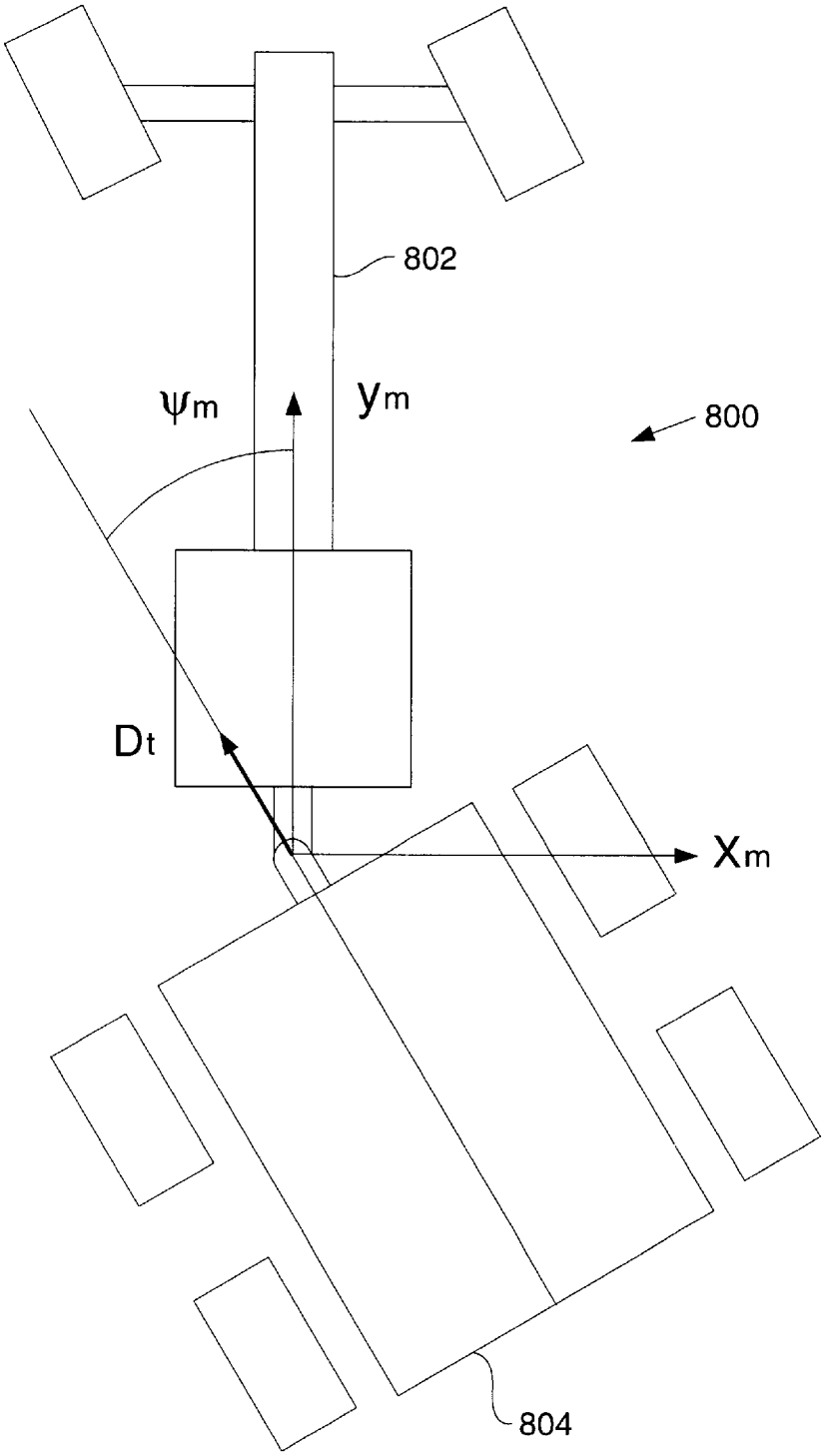
FIG. 9 is an example of the direction of travel of the articulated work machine.

As illustrated in FIG. 5, using the roll sensors 110 and 114, the roll angle $\phi_{bs}$ of the blade 104 and the roll angle $\phi_{ms}$ of the frame 106 or 802 may be sensed relative to horizontal 502. The angle of rotation $\psi_b$ of the blade 104 relative to the frame 106 or 804 may be sensed, as illustrated in FIG. 6. As illustrated in FIGS. 7*a* and 7*b*, using the pitch sensor assemblies 94 and 112, the pitch angle $\theta_{ms}$ of the frame 106 or 802 and the pitch $\theta_b$ of the blade 104 may be sensed relative to horizontal 502. FIG. 7A illustrates an angle of rotation of the circle 85 to be zero degrees for exemplary purposes only. Other circle 85, or blade 104, rotations may be performed and measured accurately using the disclosed embodiment. As illustrated in FIG. 9, the articulation angle $\Psi_m$ may be sensed relative to the rear frame 806.

As illustrated in FIG. 8, in a first embodiment in which the work machine 108 is a non-articulated motor grader, the direction of travel, $\vec{I}$, of the machine 108 may be determined relative to the center axis of the frame 106. As illustrated in FIG. 9, in a second embodiment in which the machine 800 is an articulated motor grader, the direction of travel, $\vec{D}$, of the machine 800 is determined relative to the center axis of the rear frame 806.

Figure 10:
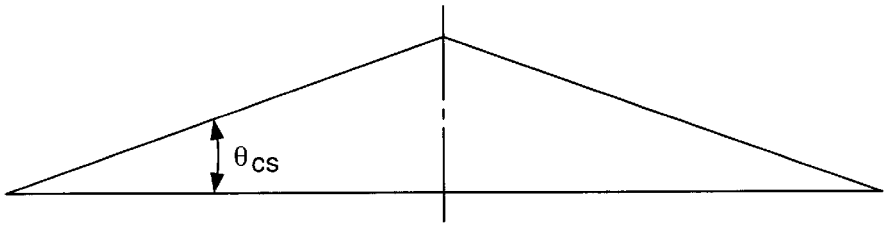
FIG. 10 is an example of the cross slope created by the machine.

In one embodiment, the cross slope, $\theta_{cs}$, created by a work machine, such as a motor grader, may be described as the slope of a line lying on a surface path, such as a road, which is perpendicular to the direction of the path, as illustrated in FIG. 10.

Figure 11:
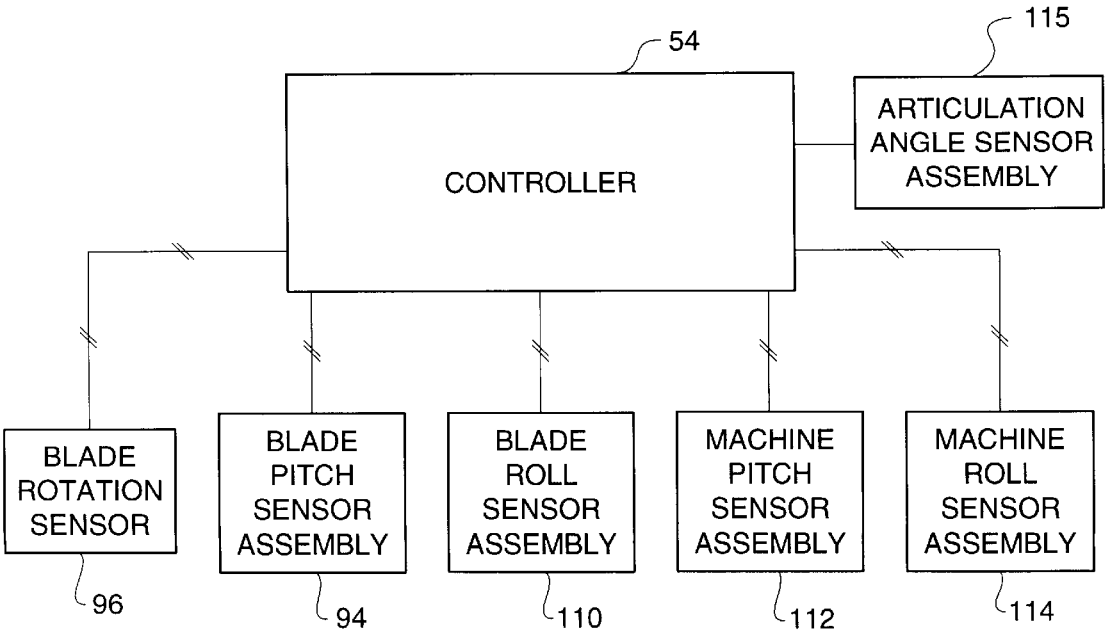
FIG. 11 is an illustration of an alternative embodiment of the apparatus for determining a cross slope created by the machine.

A controller 54 receives signals from the machine sensor system 402 and the work implement sensor system 404, as illustrated in FIG. 11. A microprocessor such as a Motorola 68HC11 may be used as the controller 54. However, other known microprocessors could be readily used without deviating from the scope of the present invention.

In the alternative embodiment, as illustrated in FIG. 11, the controller 54 may receive sensed signals from the pitch sensor assemblies 94 and 112 and the roll sensor assemblies 110 and 114. The controller 54 may also receive signals from at least one of a circle drive mechanism 82, a rotary drive motor 84, or a blade rotation sensor assembly 94 to determine the angle of rotation of the blade 104 relative to the drawbar 80.

The controller 54 determines a cross-slope in response to the sensed parameters. In one embodiment, the controller 54 receives an operator-initiated desired cross slope signal. For example, the operator may enter a desired cross-slope using a keypad (not shown) which delivers the appropriate signal to the controller 54. The actual cross slope may then be compared to the desired cross slope and a cross slope error responsively generated. The cross slope error may be used by the controller 54 to determine the necessary changes and commands that need to be delivered to either the blade 104, drawbar 80, or both to achieve the desired cross slope. The appropriate commands are then delivered by the controller 54 to adjust the cross slope created by the machine 108 or 800. The machine and work implement parameters are continuously sensed, enabling the cross slope to be continuously monitored and adjusted.

II. Determining the Cross Slope

In one embodiment, the cross slope may be determined as a function of (1) the direction of travel of the machine 108 or 800 and (2) the position of the blade 104. In the first embodiment of the present invention, the drawbar 80 is located symmetrically under the frame 106, the machine 108 is traveling in a straight line of motion, and there is not articulation of the machine 108.

In the second embodiment of the present invention, the drawbar 80 is located symmetrically under the front frame 804, the machine 800 is traveling in a straight line of motion, and there is articulation of the machine 800.

In both embodiments, for articulated and non-articulated machines, the method for determining the cross slope created by a work implement on a work machine includes the steps of determining a position of the work implement 104, determining a direction of travel of the machine 108 or 800, and determining the cross slope in response to the direction of travel and the work implement position.

A. Determine a Position of the Work Implement

In one embodiment, the position of the blade 104 may be determined in response to sensing machine and work implement parameters. Work implement parameters, such as the angle of rotation of the blade 104 relative to the machine 108 or 800 ($\psi_b$), the blade roll $\phi_{bs}$ and the blade pitch $\theta_{bs}$ may be sensed. In addition, machine parameters, such as the machine roll $\phi_{ms}$ and the machine pitch $\theta_{ms}$ may be sensed. Further, the roll and pitch of the drawbar 80 may be directly sensed by placing the appropriate sensors on the drawbars.

Figure 12:
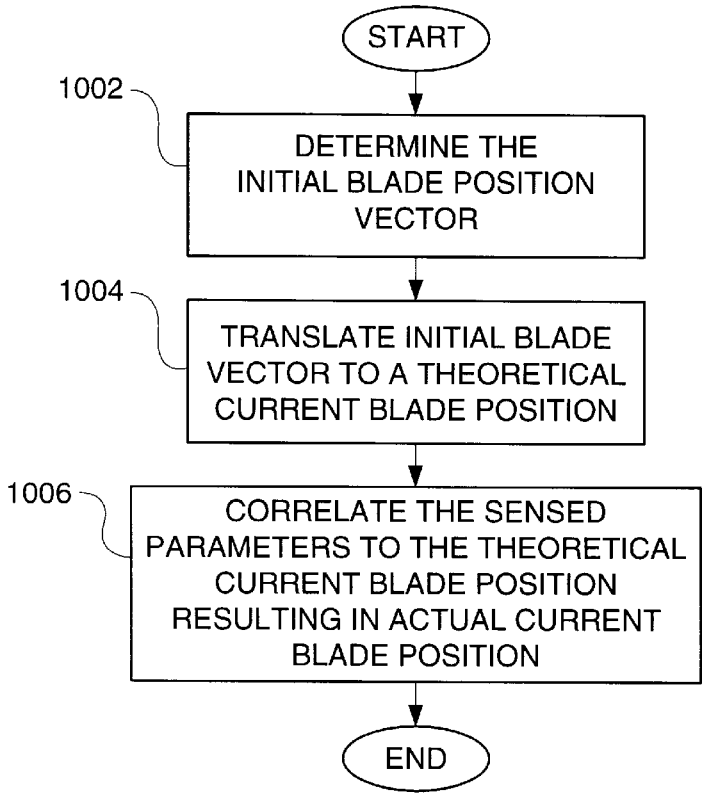
FIG. 12 is an illustration of the method for determining a cross slope.

FIG. 12 illustrates a flow diagram of an alternative method for determining the current position of the blade 104. The current position of the blade 104 may be determined by determining an initial blade position vector 1002, translating the initial blade vector to achieve a theoretical current blade position 1004, and determining the current blade position by correlating the sensed parameters to the theoretical current blade position 1006. This method is appropriate for both articulated and non-articulated work machines.

1. Determining an Initial Blade Position Vector

Figure 13:
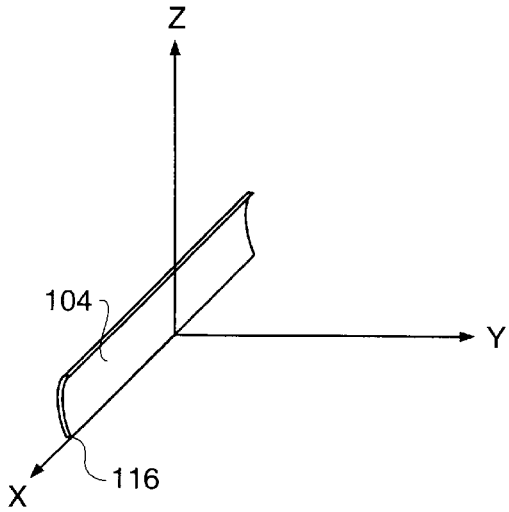
FIG. 13 is an illustration of the initial blade vector position.
Figure 14:
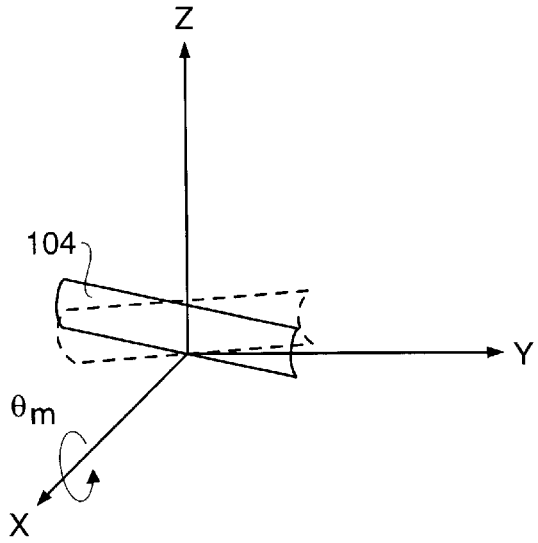
FIGS. 14*a–d* illustrates five aspects of the blade translations.

The initial blade vector $\vec{P}_{B_0}$ represents a theoretical initial position of the blade 104. A local, or machine based, coordinate system may be defined as a three dimensional coordinate system established relative to the frame 106 or 802. In one embodiment, the local coordinates may be based on earth-based coordinates. The initial blade vector may be represented as:

$$\vec{P}_{B_0} \equiv \text{Initial blade vector} = [1\ 0\ 0]^T$$

where the right hand tip 116 of the blade 104 is at $\vec{P}_{B_0}$ and the center of the blade 104 is at the origin (0,0,0), as illustrated in FIG. 13. The current blade vector may be stated as:

$$\vec{P}_{B_0} = \text{Final blade vector} = [P_{B_x}\ P_{B_y}\ P_{B_z}]^T$$

2. Achieving a Theoretical Correct Blade Position

A theoretical blade position vector may be determined by theoretically translating, or rotating, the machine 108 or 800, drawbar 80, and/or blade 104 through a sequence of maneuvers. That is, a sequence of theoretical work implement translations may be used to translate the implement from a first position, e.g., an initial position, to a second position, e.g., a current blade position. One example of the theoretical sequence of maneuvers is:

1. Rotate the blade relative to the machine ($\psi_b$);
2. Roll the drawbar ($\phi_d$);
3. Pitch the drawbar ($\theta_d$);
4. Roll the mainframe ($\phi_m$); and
5. Pitch the mainframe ($\theta_m$).

The theoretical translation sequence is illustrated in FIGS. 14*a*–14*d*. The rotational sequence yields a theoretical blade position:

$$\vec{P}_B = \begin{bmatrix} P_{B_x} \\ P_{B_y} \\ P_{B_z} \end{bmatrix} = [Rot_x(\theta_m)]\ [Rot_y(\phi_m)][Rot_x(\theta_d)]\ [Rot_y(\phi_d)] \times [Rot_z(\psi_b)] \cdot \vec{P}_{Bo}$$

Where Rot_x($\theta_m$), Rot_y($\phi_m$), Rot_x($\theta_d$), Rot_y ($\phi_d$), and Rot_z($\psi_b$) are homogeneous transforms. For example, Rot_x($\theta_m$) may be determined to be:

$$Rot_x(\theta_m) = \begin{bmatrix} 1 & 0 & 0 \\ 0 & \cos(\theta_m) & -\sin(\theta_m) \\ 0 & \sin(\theta_m) & \cos(\theta_m) \end{bmatrix}$$

Homogenous transforms are well known in the art and each transform will not be elaborated on at this point.

The theoretical blade vector $\vec{P}_B$ may be simplified by defining the overall transformation matrix as:

$$H_{b0}^{\ b} = \text{Rot_}x(\theta_m)\text{Rot_}y(\phi_m)\text{Rot_}x(\theta_d)\text{Rot_}y(\phi_d)\text{Rot_}z(\psi_b)$$

The equation for the theoretical blade position simplifies to:

$$\vec{P}_B = H_{b0}^{\ b} \cdot \vec{P}_{B_0}$$

Where:

$$H_{b0}^{b}=\begin{bmatrix} h(1,1) & h(1,2) & h(1,3) \\ h(2,1) & h(2,2) & h(2,3) \\ h(3,1) & h(3,2) & h(3,3) \end{bmatrix}=\begin{bmatrix} h_{1,1} & h_{1,2} & h_{1,3} \\ h_{2,1} & h_{2,2} & h_{2,3} \\ h_{3,1} & h_{3,2} & h_{3,3} \end{bmatrix}$$

The matrix elements may be determined by matrix algebra. For example:

$$h_{1,1}=[\cos(\phi_m)\cos(\psi_b)]\cos(\phi_d)-[\sin(\phi_m)\cos(\psi_b)]\cos(\theta_d)\sin(\phi_d)+[\sin(\phi_m)\sin(\psi_b)]\sin(\theta_d)$$

Therefore, the theoretical current blade position vector may be represented as:

$$\vec{P}_b=<h_{1,1},h_{2,1},h_{3,1}>$$

3. Determining the Current Blade Position

The actual current blade position may be determined by correlating the sensed parameters to the theoretical current blade position and determining the actual machine roll and pitch, the actual blade roll and pitch, and the blade rotation.

The variables $\phi_m$, $\phi_d$, $\theta_m$, $\theta_d$, and $\psi_b$ are theoretical translation variables. The sensed variables may be correlated to the translation variables.

In the preferred embodiment, the actual machine roll may be determined by initializing a unit vector $\hat{\iota}_{x_m}$ which is representative of the roll and pitch of the machine starting in the direction $\hat{i}_x$, where $\hat{i}_x$ is the unit vector in the x-direction. The unit vector $\hat{\iota}_{x_m}$ may be rolled with respect to the Y-axis. Therefore, the actual machine roll may be determined by the following equation:

$$\hat{\iota}_{x_m}=Rot_Pitch(Rot_Roll\cdot\hat{\iota}_x)=\begin{bmatrix} 1 & 0 & 0 \\ 0 & \cos(\theta_m) & -\sin(\theta_m) \\ 0 & \sin(\theta_m) & \cos(\theta_m) \end{bmatrix}\times\begin{bmatrix} \cos(\phi_m) & 0 & \sin(\phi_m) \\ 0 & 1 & 0 \\ -\sin(\phi_m) & 0 & \cos(\phi_m) \end{bmatrix}\begin{bmatrix} 1 \\ 0 \\ 0 \end{bmatrix}$$

To isolate the roll component, the dot product of the unit vector $\hat{\iota}_{x_m}$ in the vertical direction may be determined. The resulting actual machine roll equation is:

$$\sin(\phi_{m_s})-\cos(\theta_m)\sin(\phi_m)=0$$

The actual machine pitch may be determined by initializing a unit vector, $\hat{\iota}_{y_m}$, which is representative of the roll and pitch of the machine in the direction $\hat{i}_y$. The vector $\hat{\iota}_{y_m}$ is then rolled the amount indicated by the roll sensor and pitched by the amount indicated by the pitch sensor, resulting in:

$$\hat{\iota}_{y_m}=Rot_\text{Pitch}(\text{Rot}_\text{Roll}(i_y))$$

The dot product of the unit vector in the vertical direction may be taken to determine the pitch component of the vector $\hat{i}_y$. The resulting actual machine pitch is:

$$\sin(\theta_{m_s})=\sin(\theta_m)$$

$$\theta_m=\theta_{m_s}$$

and, by substitution, the machine roll is:

$$\phi_m=\sin^{-1}\left[\frac{\sin(\phi_{m_s})}{\cos(\theta_{m_s})}\right]$$

The actual blade roll, $\phi_b$, can be computed by determining the angle between the position of the blade 104 and the horizon 502. The blade roll with regard to the horizon (x-y plane) is given by:

$$\sin(-\phi_b)=-[H_{b0}{}^{b}\cdot\vec{P}_{B_0}]\cdot\hat{\iota}_z$$

Measurement of the actual blade pitch can be computed by determining the angle between a normal blade vector, $\vec{N}_b$, and the horizon.

$$\vec{N}_B=H_{b0}{}^{b}\cdot\vec{N}_{B_0}$$

where:

$$\vec{N}_{B_0}=[0\ 1\ 0]$$

The actual blade pitch, with regard to the horizon (x-y plane), may be given by:

$$\sin(\theta_b)=-[H_{b0}{}^{b}\cdot\vec{N}_{B_0}]\bullet\hat{\iota}_z$$

The actual drawbar pitch and roll may also be determined. The following analysis is based on the assumption that there is no direct sensing of the drawbar 80 pitch and roll. If there is a direct sensing means, such as a roll or pitch sensor attached to the drawbar 80, then analysis analogous to the above determinations of machine roll and machine pitch may be used to determine drawbar roll and drawbar pitch.

If there is no direct sensing of the drawbar pitch $\theta_d$ and roll $\phi_d$, a numerical analysis approach for solving systems of non-linear equations, such as the Newton-Raphson Method, may be used to solve for them.

$$\sin(\phi_b)=-[H_{b0}{}^{b}\cdot\vec{P}_{B_0}]\bullet\vec{\iota}_z\Rightarrow f_1(\psi_b,\theta_b,\phi_b,\theta_m,\phi_m,\theta_d\phi_d)=0$$

$$\sin(-\theta_b)=-[H_{b0}{}^{b}\cdot\vec{N}_{B_0}]\bullet\vec{\iota}_z\Rightarrow f_2(\psi_b,\theta_b,\phi_b,\theta_m,\phi_m,\theta_d,\phi_d)=0$$

$$f_1(\theta_d,\phi_d)=0$$

$$f_2(\theta_d,\phi_d)=0$$

Solving for $\theta_d$ and $\phi_d$ via the Newton-Raphson Method:

$$F(x_k)=\begin{bmatrix} f_1(x_1,x_2) \\ f_2(x_1,x_2) \end{bmatrix}$$

$$x_k=\begin{bmatrix} x_1 \\ x_2 \end{bmatrix}=\begin{bmatrix} \theta_d \\ \phi_d \end{bmatrix}$$

$$x_{k+1}=x_k-J_k^{-1}\cdot F(x_k)$$

where $J_k$ represents a Jacobian matrix.

$$J^{-1}=\frac{\begin{bmatrix} \frac{\partial f_2}{\partial\phi_d} & \frac{-\partial f_1}{\partial\phi_d} \\ \frac{-\partial f_2}{\partial\theta_d} & \frac{\partial f_1}{\partial\theta_d} \end{bmatrix}}{\Delta J}$$

Where:

$$\Delta J=\left(\frac{\partial f_1}{\partial\theta_d}\right)\left(\frac{\partial f_2}{\partial\phi_d}\right)-\left(\frac{\partial f_1}{\partial\phi_d}\right)\left(\frac{\partial f_2}{\partial\theta_d}\right)$$

$$x=\begin{bmatrix} \theta_d \\ \phi_d \end{bmatrix}$$

$$x_0 = \begin{bmatrix} \theta_b \\ \phi_b \end{bmatrix}$$

For an initial estimate of blade position, the initial drawbar pitch and roll may be assumed to be equal to the initial blade pitch and roll. This assumption provides an initial estimate that may be modified. Alternatively, the last drawbar pitch and roll calculated may be used.

Therefore, the actual current blade position may be determined using:

$$\vec{P}_{B_x}=h_{1,1}=g_1(\psi_b,\theta_m,\phi_m,\theta_d,\phi_d)$$

$$\vec{P}_{B_y}=h_{2,1}=g_2(\psi_b,\theta_m,\phi_m,\theta_d,\phi_d), \text{ and}$$

$$\vec{P}_{B_z}=h_{3,1}=g_3(\psi_b,\theta_m,\phi_m,\theta_d,\phi_d)$$

Where $g_x(\psi_b,\theta_m,\phi_m,\theta_d,\phi_d)$ represents the functional analysis illustrated above.

B. Determining a Direction of Travel of the Machine

The current blade position may be used in conjunction with the direction of travel of the machine to determine the cross slope, and the direction of travel of the machine may be represented by a direction path vector $\vec{D}_t$.

1. Non-articulated Work Machines

In the first embodiment, the machine 108 is operating in a non-articulated manner. Therefore, the direction path vector $\vec{D}_t$ is aligned with the frame 106 and is affected only by the pitch of the machine 108. Therefore, the direction path vector may be given by the following equation:

$$\vec{D}_t=<0,\cos(\theta_m),\sin(\theta_m)>^T$$

2. Articulated Work Machines

In the second embodiment, the machine 800 is operating in an articulated manner. Therefore, the direction path vector $\vec{D}_t$ is aligned with the rear frame 806, as most easily seen in FIG. 9. Because $\vec{D}_t$ is not aligned with the front frame 804, machine pitch ($\theta_m$) machine roll ($\phi_m$), and the articulation angle ($\psi_m$) affect the direction vector $\vec{D}_t$. Therefore, the initial direction path vector is given by the following equation:

$$\vec{D}_{t_o}=-\sin(\psi_m)\hat{i}_{xm}+\cos(\psi_m)\hat{i}_{ym}$$

After adding the machine pitch and roll, the direction vector is expressed as:

$$\vec{D}_t=[rot_x(\theta_m)][rot_y(\phi_m)]\vec{D}_{t_o}$$

which simplifies to:

$$\vec{D}_t=<d_{tx},d_{ty},d_{tz}>$$

where $d_{tx}=-\cos(\phi_m)\sin(\psi_m)$ $d_{ty}=-\sin(\theta_m)\sin(\phi_m)\sin(\psi_m)+\cos(\theta_m)\cos(\psi_m)$ $d_{tz}=\cos(\theta_m)\sin(\phi_m)\sin(\psi_m)+\sin(\theta_m)\cos(\psi_m)$ C. Determining the Cross Slope The cross slope is a function of the blade position vector and the direction of travel vector:

$$\text{CrossSlope}=f(\vec{D}_t,\vec{P}_b)$$

The cross slope, $\theta_{cs}$, may be represented as a vertical measurement that is perpendicular to the direction of travel and is measured with respect to the horizon, as illustrated in FIG. 10. The blade's path as it passed through the cross section of the cut plane may be determined.

1. Non-Articulated Work Machines

Figure 15:
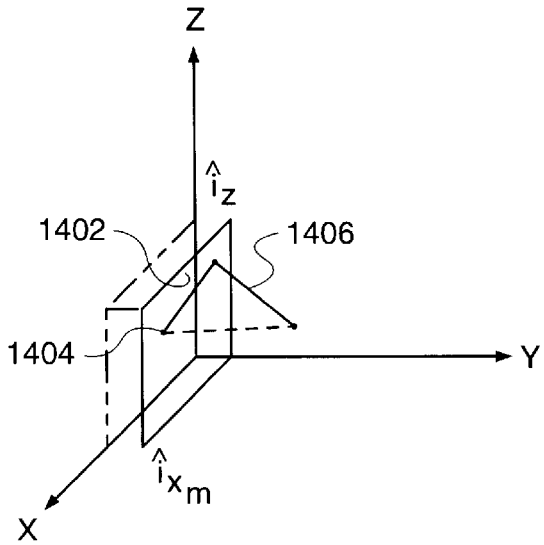
FIG. 15 is an illustration of the cross slope plane.
Figure 14A:
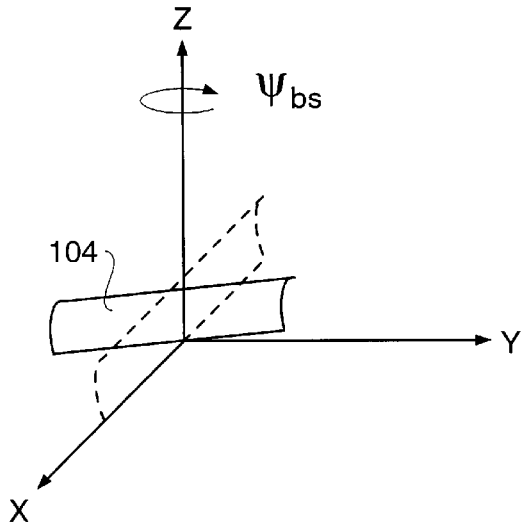
Figure 14B:
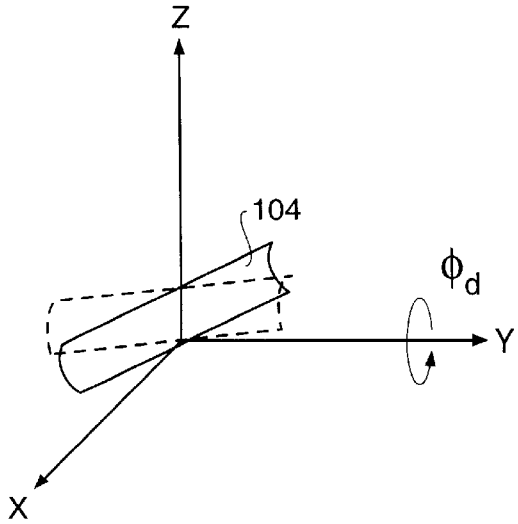
Figure 14C:
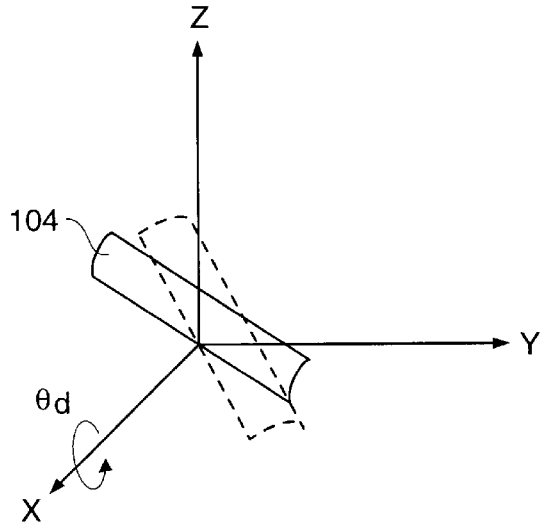
Figure 14D:
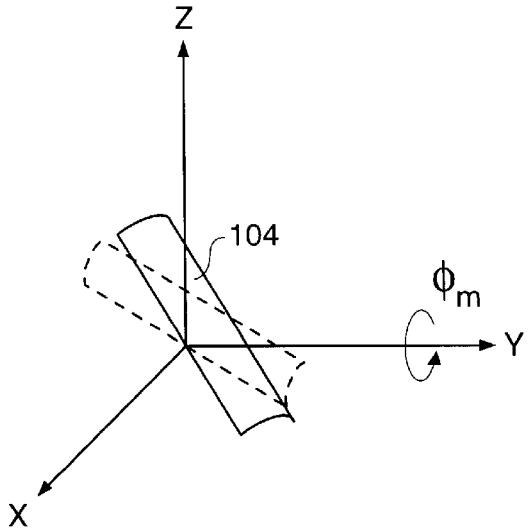

In the first embodiment, in which the work machine 108 is not articulated, the cross slope plane may be illustrated as the $x_m$-z plane, as shown in FIG. 15. A normal vector that crosses through the cross slope cut plane 1402 may be determined. The normal vector may be determined by taking the cross product of two known vectors that lie within the plane, such as $\hat{\iota}_{x_m}$, which contains the point $\vec{P}_{B_o}$, and $\hat{\iota}_z$, which contains the point (0,0,0) and is part of the earth coordinate system. Therefore:

$$\vec{N}_{x_s}=\hat{\iota}_{x_m}\times\hat{\iota}_z$$

Where:

$$\hat{\iota}_{x_m}=\text{Rot_Pitch}(\text{Rot}_{_Roll}(\hat{\iota}_x))$$

Resulting in $$\therefore \vec{N}_{x_s} = \begin{bmatrix} \sin(\theta_m)\sin(\phi_m) \\ -\cos(i_m) \\ 0 \end{bmatrix}$$

Therefore, the plane equation containing the point $x_0$, $y_0$, $z_0$=(0,0,0): is $$[\sin(\theta m)\sin(\phi m)]\cdot x+[-\cos(\phi m)]y=0$$

Preferably, the machine follows straight line motion, where no angular variables are changing. Therefore, the right blade tip follows a line l:

$$l_r: x = P_{b_x},\ \frac{y-P_{b_y}}{\cos(\theta_m)} = \frac{z-P_{b_z}}{\sin(\theta_m)}$$

The cross slope may then be determined by projecting $\vec{P}_B$ back or forward in time, along the line l 1406, until it intersects the cross slope plane, as illustrated in FIG. 15. The point of intersection (x*, y*, z*) 1404 is:

$$x^* = P_{b_x},\ y^* = \frac{\sin(\theta_m)\cdot\sin(\phi_m)\cdot x^*}{\cos(\phi_m)},\ z^* = -\tan(\theta_m)\cdot P_{b_y}+P_{b_z}$$

The x,y component is the measure of this point along the $\hat{\iota}_{x_m}$ direction. Therefore, the measurement of the x,y component is:

$$r=\sqrt{x^{*2}+y^{*2}}$$

The cross slope created by the work implement 104 of a machine 108 may then be defined as:

$$\text{Cross Slope} = \frac{-z^*}{\sqrt{x^{*2}+y^{*2}}} = \frac{\Delta z}{\Delta r}$$

2. Articulated Work Machines

In the second embodiment, in which the work machine 800 is articulated, the cross slope may also be illustrated as the $x_m$-z plane, as shown in FIG. 15. A normal vector that crosses through the cross slope cut plane 1402 may be determined by taking two known vectors that lie within the plane and calculating the cross product of those vectors. One of the known vectors $\hat{\iota}_z$ contains the point (0,0,0) and lies within the earth coordinate system. The other known vector $\hat{\iota}_{cs}$ contains the point $\vec{P}_{B_0}$.

$$\vec{N}_c = \vec{i}_c \times \hat{i}_c = \begin{vmatrix} i_x & 0 & 0 \\ i_{cx} & i_{cy} & i_{cz} \\ 0 & 0 & 1 \end{vmatrix}$$

where $$\vec{I}_c = [\mathrm{rot_}x(\theta_m)][\mathrm{rot_}y(\phi_m)]\vec{I}_{c_0}$$

is perpendicular to the direction of travel $\vec{D}_t$ after machine pitch and roll. This results in:

$$\vec{I}_c = \langle i_{cx}, i_{cy}, i_{cz} \rangle$$

where $i_{cx}\cos(\phi_m)\cos(\psi_m)$ $i_{cy}=\sin(\theta_m)\sin(\phi_m)\cos(\psi_m)+\cos(\theta_m)\sin(\psi_m)$ $i_{cz}=-\cos(\theta_m)\sin(\phi_m)\cos(\psi_m)+\sin(\theta_m)\sin(\psi_m)$ The cross product of $\vec{I}_c$ and $\hat{\iota}_z$ can be performed, yielding the normal vector to the cut plane.

$$\vec{N}_c = \begin{bmatrix} n_x \\ n_y \\ n_z \end{bmatrix} = \begin{bmatrix} \cos(\theta_m)\sin(\psi_m) + \sin(\theta_m)\sin(\phi_m)\cos(\psi_m) \\ -\cos(\phi_m)\cos(\psi_m) \\ 0 \end{bmatrix}$$

The projection of the blade tip $P_b$, along the line $l_t$ 1406, onto the cut plane $P_c$, occurs at the point (x*,y*,z*) 1404, as seen in FIG. 15. Solving for x*, y*, and z as a system, the projection line, which the right blade tip follows, is expressed as:

$$l_t : \frac{x^* - P_{bx}}{d_{tx}} = \frac{y^* - P_{by}}{d_{ty}} = \frac{z^* - P_{bz}}{d_{tz}}$$

and the cut plane is expressed as:

$$P_c : n_x(x^*-0)+n_y(y^*-0)+n_z(z^*-0)=0$$

The cross slope may be determined by projecting $\vec{P}_B$ back or forward in time, along the line l 1406, until it intersects the cross slope plane, as seen in FIG. 15. The point of intersection (x*,y*,z*) 1404 is: 1404 is:

$$y^* = \frac{-n_x a_0 - n_z b_0}{n_x a_1 + n_y b_1 + n_y}$$

$$x^* = \underbrace{\left[\frac{d_{tx}}{d_{ty}}\right]}_{a_1} y^* + \underbrace{\left[P_{bx} - \frac{d_{tx}}{d_{ty}} P_{by}\right]}_{a_0} = a_1 y^* + a_0$$

$$z^* = \underbrace{\left[\frac{d_{tz}}{d_{ty}}\right]}_{b_1} y^* + \underbrace{\left[P_{bz} - \frac{d_{tx}}{d_{ty}} P_{by}\right]}_{b_0} = b_1 y^* + b_0$$

The x,y component is the measure of this point in the $\hat{i}_{cs}$ direction. Therefore, the measurement of the x,y component is:

$$r=\sqrt{x^{*2}+y^{*2}}$$

The cross slope created by the blade 104 of the machine 800 may then be defined as:

$$X_z = \frac{\Delta Z}{\Delta R} = \frac{-z^*}{\sqrt{(x^*)^2 + (y^*)^2}}$$

Industrial Applicability

The present invention provides a method and apparatus for determining the cross slope created by a work implement on a work machine. In a first embodiment, the method includes the steps of determining a position of the work implement, determining a direction of travel of the machine, and determining a cross slope in response to the direction of travel and the work implement position.

In a second embodiment, a plurality of machine parameters, such as the roll of the machine, and work implement parameters, such as the angle of rotation of the work implement relative to the machine, are used to determine the position of the work implement.

In a third embodiment, the actual cross slope is determined and then compared to a desired cross slope. The desired cross slope may be determined in response to either an operator input or a program that is providing automated control of some or all of the grading functions of the motor grader. The machine 108 or 800 and/or the blade 104 may be controlled in response to the desired and actual cross slope. For example, if an error exists between the actual and desired cross slope, the implement commands may be determined which will bring the actual cross slope to within a threshold of the desired cross slope. The threshold may be determined based on the desired accuracy of the system.

Other aspects, objects, and features of the present invention can be obtained from a study of the drawings, the disclosure, and the appended claims.

What is claimed is:

1. A method for determining a cross slope created by a work implement on a work machine, the work machine comprised of movably connected front and rear frames, said work implement movably connected to at least one of said frames, comprising the steps of:

sensing a plurality of machine parameters, said machine parameters including at least a roll of said work machine, a pitch of said work machine, and an articulation angle;

sensing at least one work implement parameter, said work parameter including at least an angle of rotation of said work implement relative to said work machine;

determining a position of said work implement in response to said work machine parameters and said at least one work implement parameter;

determining a direction of travel of at least one of said frames of said work machine; and determining a cross slope in response to said at least one direction of travel and said work implement position.

2. The method, as set forth in claim 1, wherein the step of sensing said at least one work implement parameter includes the step of determining a pitch of said work implement relative to said work machine.

3. The method, as set forth in claim 2, wherein the step of sensing said at least one work implement parameter includes the step of determining a roll of said work implement relative to said work machine.

4. The method, as set forth in claim 1, wherein the step of sensing said at least one work implement parameter includes the steps of:

determining a pitch of said work implement relative to the earth's gravitational field; and determining a roll of said work implement relative to the earth's gravitational field.

5. The method, as set forth in claim 4, wherein the step of determining a direction of travel includes the step of correlating said pitch of said work machine, said roll of said work machine, and said articulation angle to the direction of travel of at least one of said frames.

6. The method, as set forth in claim 5, including the steps of:

comparing said cross slope with a desired cross slope; and determining a cross slope error in response to said comparison.

7. The method, as set forth in claim 6, including the step of controlling said work implement in response to said cross slope error.

8. The method, as set forth in claim 7, wherein the step of determining said work implement position includes the step of:

determining said work implement position in response to a sequence of theoretical work implement translations from a first work implement position to a second work implement position.

9. The method, as set forth in claim 8, wherein said sequence of theoretical work implement translations includes the steps of:

translating an angle of rotation of said work implement to account for rotation of said work implement;

translating said work implement to account for a roll of said work implement; and translating said work implement to account for a pitch of said work implement.

10. The method, as set forth in claim 8, including the step of correlating said sensed machine parameters and said at least one sensed work implement parameter to variables associated with theoretical work implement translations.

11. The method, as set forth in claim 1, wherein said step of determining a direction of travel includes the step of correlating said pitch of said work machine, said roll of said work machine, and said articulation angle to the direction of travel of at least one of said frames.

12. A method for determining a cross slope created by a work implement on a work machine, the work machine comprised of movably connected front and rear frames, said work implement movably connected to at least one of said frames, comprising the steps of:

sensing a plurality of machine parameters, said machine parameters including a roll of said work machine, a pitch of said work machine, and an articulation angle;

sensing a plurality of work implement parameters, said work implement parameters including an angle of rotation of said work implement relative to said work machine; and determining said cross slope in response to said machine parameters and said work implement parameters including said angle of rotation of said work implement.

13. The method, as set forth in claim 12, wherein said step of determining said cross slope includes the steps of:

determining a direction of travel of at least one of said frames in response to said roll of said work machine, said pitch of said work machine, and said articulation angle; and determining said cross slope in response to said direction of travel.

14. The method, as set forth in claim 12, wherein the step of sensing a plurality of work implement parameters includes the steps of:

determining a pitch of the work implement relative to the earth's gravitational field; and determining a roll of the work implement relative to the earth's gravitational field.

15. The method, as set forth in claim 14, wherein the step of sensing a plurality of work implement parameters includes the steps of:

determining a pitch of the work implement relative to the machine; and determining a roll of the work implement relative to the machine.

16. The method, as set forth in claim 15, including the step of determining a direction of said machine, wherein said cross slope is determined in response to said direction of said machine, said machine parameters, said work implement parameters, and said angle of rotation of said work implement.

17. The method, as set forth in claim 16, wherein said step of determining said direction of said machine includes the step of:

determining said direction of said machine in response to said roll of said machine, said pitch of said machine, and said articulation angle.

18. The method, as set forth in claim 16, wherein the step of determining said work implement position includes the steps of:

determining said work implement position in response to a sequence of theoretical work implement translations from a first work implement position to a second work implement position.

19. The method, as set forth in claim 18, wherein said sequence of theoretical work implement translations includes the steps of:

translating said work implement angle of rotation to account for said work implement rotation;

translating said work implement to account for said work implement roll; and translating said work implement to account for said work implement pitch.

20. An apparatus configured to determine a cross slope created by a work machine having a work implement, the work machine including front and rear frames movably connected, the work implement being movably connected to at least one of said frames of the work machine, comprising:

a machine sensor system configured to sense a plurality of machine parameters and responsively generate a plurality of machine parameter signals;

a work implement sensor system configured to determine a plurality of work implement parameters and responsively generate a plurality of work implement parameter signals; and a controller configured to receive said machine parameter signals and said work implement parameter signals, determine a direction of travel of the machine in response to said machine and said work implement parameters, determine a position of said work implement in response to said machine and said work implement parameters, and determine the cross slope in response to said machine direction of travel and said work implement position.

21. The apparatus, as set forth in claim 20, wherein said machine sensor system includes:

a roll sensor configured to determine a roll of the machine;

a pitch sensor configured to determine a pitch of the machine; and an articulation angle sensor to determine the articulation of the machine.

22. The apparatus, as set forth in claim 21, wherein said controller determines said direction of travel of said machine in response to said roll of the machine, said pitch of the machine and said articulation angle.

23. The apparatus, as set forth in claim 22, wherein said work implement sensor system includes:

a roll sensor configured to determine a roll of the work implement relative to the machine; and a pitch sensor configured to determine a pitch of the work implement relative to the machine.

24. The apparatus, as set forth in claim 23, wherein said work implement sensor system includes:

a roll sensor configured to determine a roll of the work implement relative to the earth's gravitational field; and a pitch sensor configured to determine a pitch of the work implement relative to the earth's gravitational field.

25. The apparatus, as set forth in claim 24, wherein said controller determines an angle of rotation of said work implement relative to the machine, and wherein said controller determines cross slope in response to said machine parameters, said work implement parameters and said angle of rotation.

26. The apparatus, as set forth in claim 24, wherein said work implement sensor system includes a rotation sensor configured to sense an angle of rotation of the work implement relative to the machine and responsively generate an angle of rotation signal, said work implement parameter signals including said angle of rotation signal.

27. A method for determining a cross slope created by a work implement on a work machine, the work machine including front and rear frames movably connected, the work implement being movably connected to at least one of said frames of the work machine, comprising the steps of:

determining a position of said work implement;

determining a direction of travel of at least one of said frames;

establishing an angle of rotation of the work implement relative to the machine; and determining a cross slope in response to said direction of travel of at least one of said frames and said work implement position.

28. The method, as set forth in claim 27, including the steps of:

sensing a plurality of machine parameters, said machine parameters including a roll of said machine, a pitch of said machine, and an articulation angle of said machine;

sensing at least one work implement parameter, said at least one work implement parameter including an implement angle of rotation; and wherein, the step of determining said work implement position includes the step of determining said work implement position in response to said machine parameters and said at least one work implement parameter, including said implement angle of rotation.

29. The method, as set forth in claim 28, wherein the step of determining said at least one work implement parameter includes the step of determining a pitch of said work implement relative to said machine.

30. The method, as set forth in claim 29, wherein the step of determining said direction of travel includes the step of:

determining said direction of at least one of said frames in response to said roll of said machine, said pitch of said machine, and said articulation angle.

31. The method, as set forth in claim 27, including the steps of:

comparing said cross slope with a desired cross slope; and determining a cross slope error in response to said comparison.

32. The method, as set forth in claim 31, including the step of controlling said work implement in response to said cross slope error.

33. An apparatus configured to determine a cross slope created by a work machine having a work implement, the machine having front and rear frames movably connected, the work implement being movably connected to at least one of said frames of the work machine, comprising:

a machine sensor system configured to sense a plurality of machine parameters, including a roll of said machine, a pitch of said machine, and an articulation of said machine, and responsively generate a plurality of machine parameter signals, said signals corresponding to said roll of said machine, said pitch of said machine, and said articulation angle of said machine;

a work implement sensor system configured to determine a plurality of work implement parameters, one of said work implement parameters being an angle of rotation of the work implement relative to the machine, and responsively generate a plurality of work implement parameter signals; and a controller configured to receive said machine parameter signals and said work implement parameter signals, determine at least one of a direction of travel of the machine and a direction of travel of the work implement in response to said roll of said machine, said pitch of said machine, said articulation angle of said machine, and said work implement parameters, including said angle of rotation, determine a position of said work implement in response to said machine and said work implement parameters, and determine the cross slope in response to said at least one of said direction of travel of said machine and said direction of travel of said work implement and said work implement position.

* * * * *